US011225081B2

(12) United States Patent
Osawa

(10) Patent No.: US 11,225,081 B2
(45) Date of Patent: Jan. 18, 2022

(54) CLEANING DEVICE, HEAD CLEANING DEVICE AND INKJET IMAGE FORMING APPARATUS

(71) Applicant: Konica Minolta, Inc., Tokyo (JP)

(72) Inventor: Satoru Osawa, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/824,472

(22) Filed: Mar. 19, 2020

(65) Prior Publication Data

US 2020/0307222 A1 Oct. 1, 2020

(30) Foreign Application Priority Data

Mar. 26, 2019 (JP) ..... JP2019-059212

(51) Int. Cl.
*B41J 2/165* (2006.01)

(52) U.S. Cl.
CPC ..... *B41J 2/16541* (2013.01); *B41J 2/16535* (2013.01); *B41J 2/16552* (2013.01)

(58) Field of Classification Search
CPC ..... B41J 2/16541; B41J 2/16535; B41J 2/16552; B41J 2/16547; B41J 2/16538; B41J 2/16508; B41J 2/16585; B41J 2002/1655; B41J 2002/16558; B41J 2025/008
See application file for complete search history.

(56) References Cited

U.S. PATENT DOCUMENTS

2019/0126624 A1* 5/2019 Yoshida ..... B41J 2/16523

FOREIGN PATENT DOCUMENTS

JP 2010-280067 A 12/2010

* cited by examiner

*Primary Examiner* — Sharon Polk
(74) *Attorney, Agent, or Firm* — Squire Patton Boggs (US) LLP

(57) ABSTRACT

A cleaning device includes: a cleaning member that comes into contact with a cleaning subject member and cleans the cleaning subject member using a liquid; and a liquid supply member that holds the liquid on a surface that is in contact with the cleaning member and supplies the held liquid to the cleaning member via the surface. The liquid supply member includes a plurality of holders that hold a different amount of liquid from each other in the surface.

19 Claims, 9 Drawing Sheets

CLEANING DEVICE, HEAD CLEANING DEVICE AND INKJET IMAGE FORMING APPARATUS

CROSS REFERENCE TO RELATED APPLICATION

The entire disclosure of Japanese Patent Application No. 2019-59212 filed on Mar. 26, 2019 is incorporated herein by reference in its entirety.

BACKGROUND

Technological Field

The present invention relates to a cleaning device, a head cleaning device and an inkjet image forming apparatus.

Description of Related Art

In recent years, as apparatuses that record a high-definition image on various recording mediums such as paper and cloth, inkjet image forming apparatuses of a type in which ink is discharged from a nozzle of an inkjet head have been widely prevalent.

In such inkjet image forming apparatuses, if an image forming operation is performed with ink (residual ink) and foreign substances adhering to a nozzle surface of an inkjet head left as they are, a defective image attributable to, for example, skewed ink jetting may be generated. Therefore, in the inkjet image forming apparatuses, in order to prevent generation of such defective image, it is necessary to regularly clean the inkjet head.

Conventionally, various types of head cleaning devices that bring a cleaning member (also referred to as, for example, a wiping member or a wiping material) such as cloth into contact with a nozzle surface to remove residual ink and other foreign substances from the nozzle surface and various types of inkjet image forming apparatus including such head cleaning device have been provided.

For example, Japanese Patent Application Laid-Open No. 2010-280067 proposes a configuration in which a cleaning liquid containing a solvent in which residual ink dissolves is sprayed using a sprayer to wet a cleaning member and a nozzle surface is wiped with the wet cleaning member.

Also, if ink is left adhering to a conveyance member that conveys a recording medium (for example, a conveyance belt or a conveyance roller) or an intermediate transfer member that carries ink (for example, a transfer belt), the problem of the residual ink adhering to a next recording medium and causing deterioration in print quality occurs. Therefore, in order to regularly clean various members that ink may adhere to, there are some models of inkjet image forming apparatuses including cleaning devices for these members.

In the cleaning devices, where residual ink adheres to a cleaning subject member (for example, an inkjet head) to be cleaned, it is necessary to change the amount of liquid (a cleaning liquid or the like) to be supplied to a cleaning member and thus a cleaning subject part (for example, a nozzle surface) according to, for example, the amount of the residual ink, the viscosity of the residual ink and whether or not cleaning has been completed.

More specifically, for example, as the viscosity of the residual ink adhering to the nozzle surface is larger, it is necessary to supply a larger amount of liquid to the cleaning subject part to wet the part the residual ink adheres to. Also, after removal of the residual ink, it is necessary to stop the supply of the liquid to the cleaning subject part and absorb the cleaning liquid or the like remaining on the cleaning subject part, with a dry part of the cleaning member.

Regarding this point, the technique described in Japanese Patent Application Laid-Open No. 2010-280067 provides a configuration in which the amount of cleaning liquid to be supplied to a nozzle surface is changed according to the particle size of a functional material included in residual ink, with no consideration of the viscosity of the residual ink.

Also, in the first place, the configuration in which a cleaning liquid is sprayed with a sprayer to wet a nozzle surface, such as in Japanese Patent Application Laid-Open No. 2010-280067, causes unevenness of spraying, and thus, makes it difficult to evenly wet a cleaning member, and furthermore, causes, for example, the problem of a mist of the cleaning liquid flying and falling on other members.

On the other hand, a configuration in which a liquid holding member such as an application roller is brought into contact with a cleaning member to supply (apply) a cleaning liquid or the like and the amount of the cleaning liquid or the like to be supplied from the liquid holding member to the cleaning member is adjusted by adjusting the force of pressure contact between the members is conceivable.

However, in a state in which the liquid holding member and the cleaning member are in contact with each other, liquid held by the application roller or the like is transferred to the cleaning member by means of, for example, a capillary action. Therefore, it is not easy to provide the configuration in which the amount of liquid to be supplied is adjusted by changing the force of pressure contact between the members.

As stated above, the conventional technique is unable to properly supply a liquid such as a cleaning liquid to a cleaning member.

SUMMARY

An object of the present invention is to provide a cleaning device, a head cleaning device and an inkjet image forming apparatus that enable proper supplying of a liquid to a cleaning member.

To achieve at least one of the abovementioned objects, according to an aspect of the present invention, a cleaning device reflecting one aspect of the present invention comprises:

- a cleaner that comes into contact with a cleaning subject member and cleans the cleaning subject member using a liquid; and
- a liquid supplier that holds the liquid on a surface that is in contact with the cleaner and supplies the held liquid to the cleaner via the surface,
- wherein the liquid supplier includes a plurality of holders that hold a different amount of the liquid from each other in the surface.

To achieve at least one of the abovementioned objects, according to an aspect of the present invention, a head cleaning device reflecting another aspect of the present invention comprises: the cleaning device described above, the cleaning device being movable, wherein:

- the cleaning subject member is an inkjet head; and
- the cleaner moves relative to the inkjet head to clean a nozzle surface of the inkjet head.

To achieve at least one of the abovementioned objects, according to an aspect of the present invention, an inkjet image forming apparatus reflecting another aspect of the present invention comprises:

the head cleaning device described above; and a conveyor that conveys a recording medium in such a manner that the recording medium faces the inkjet head.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
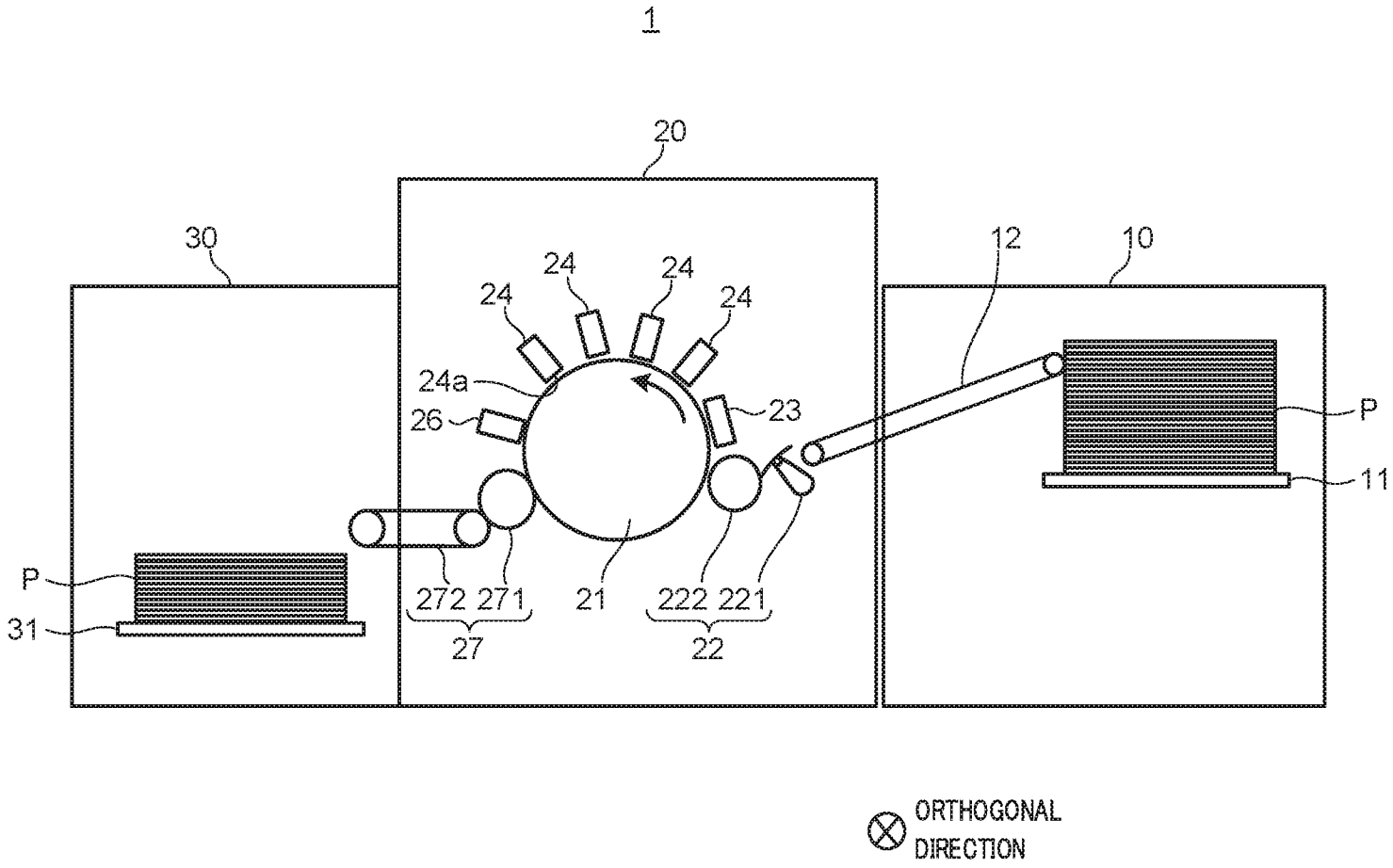
FIG. 1 is a front view for illustrating a schematic configuration of an inkjet image forming apparatus according to the present embodiment.

FIG. 1 is a schematic configuration diagram illustrating an example of inkjet image forming apparatus 1 according to the present embodiment.

Figure 5:
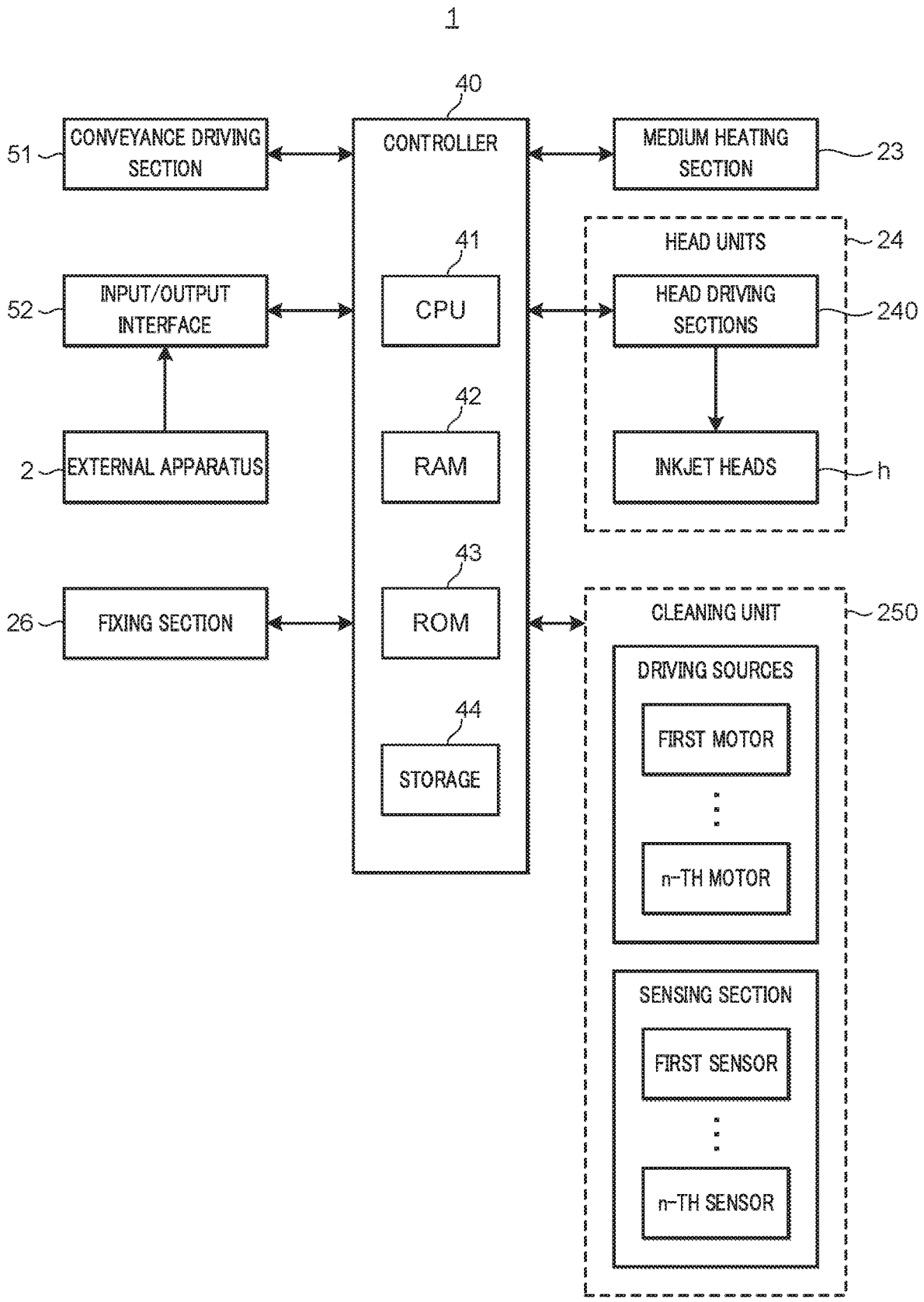
FIG. 5 is a block diagram illustrating a main functional configuration of the inkjet image forming apparatus according to the present embodiment.

Inkjet image forming apparatus 1 includes sheet feeding section 10, image forming section 20, sheet ejection section 30 and controller 40 (see FIG. 5). Under the control of controller 40, inkjet image forming apparatus 1 conveys recording medium P stored in sheet feeding section 10 to image forming section 20, forms an image on recording medium P in image forming section 20 and conveys (ejects) recording medium P with the image formed thereon to sheet ejection section 30.

For recording medium P, any of various mediums that enable an ink landed on a surface thereof to be fixed thereto, including cloth and sheet-like resin in addition to paper such as normal paper and coated paper, can be used.

Sheet feeding section 10 includes sheet feed tray 11 that stores recording mediums P and medium supply section 12 that conveys and supplies recording medium P from sheet feed tray 11 to image forming section 20.

Sheet feed tray 11 is a plate-like member provided so as to allow one or more recording mediums P to be loaded thereon. Sheet feed tray 11 is provided so as to move up and down according to an amount of recording mediums P loaded on sheet feed tray 11 and is held at a position at which uppermost recording medium P is conveyed by conveyance section 12, in a direction of the up/down movement.

Medium supply section 12 includes a looped belt, the inside of which is supported by two rollers, and the rollers are rotated with recording medium P placed on the belt to convey recording medium P from sheet feed tray 11 to image forming section 20.

Image forming section 20 includes conveyance drum 21, delivery unit 22, medium heating section 23, head units 24, cleaning device 25 (see FIG. 2), fixing section 26 and delivery section 27. Among those, cleaning device 25 correspond to "cleaning device" and "head cleaning device" according to the present invention.

With recording medium P held on an outer circumferential curved surface (conveyance surface) having a cylindrical surface shape, conveyance drum 21 is rotated around a rotation axis extending in a direction perpendicular to the sheet of FIG. 1 (hereinafter referred to as "orthogonal direction") to convey recording medium P in a conveyance direction along the conveyance surface (see the arrow in FIG. 1).

Conveyance drum 21 includes non-illustrated lug portions and suction section for holding recording medium P on the conveyance surface. Recording medium P is held on the conveyance surface as a result of end portions of recording medium P being held by the lug portions and recording medium P being sucked to the conveyance surface by the suction section.

Conveyance drum 21 includes a non-illustrated conveyance drum motor for rotating conveyance drum 21 and rotates by an angle proportional to an amount of rotation of the conveyance drum motor. Note that conveyance drum 21 and the conveyance drum motor correspond to "conveyor" that conveys recording medium P in such a manner that recording medium P faces inkjet heads h of the head units 24 (see FIGS. 2 and 5).

Delivery unit 22 delivers recording medium P conveyed by medium supply section 12 of sheet feeding section 10 to conveyance drum 21. Delivery unit 22 is provided at a position between medium supply section 12 of sheet feeding section 10 and conveyance drum 21 and holds and picks up an end of recording medium P conveyed from medium supply section 12, via swing arm portion 221 and delivers recording medium P to conveyance drum 21 via delivery drum 222.

Medium heating section 23 is provided between a position at which delivery drum 222 is disposed and a position at which the head units 24 are disposed and heats the conveyance surface of conveyance drum 21 and recording medium P conveyed by conveyance drum 21 so that recording medium P has a temperature within a predetermined range. Medium heating section 23 includes, for example, an infrared heater and supplies power to the infrared heater based on a control signal supplied from controller 40 (see FIG. 5) to make the infrared heater generate heat.

Each head unit 24 discharges an ink to recording medium P from a nozzle opening portion provided in an ink discharge surface facing the conveyance surface of conveyance drum 21, at a proper timing responding to rotation of conveyance drum 21 holding recording medium P to record (form) an image. Each head unit 24 is disposed so that the ink discharge surface and the conveyance surface are spaced a predetermined distance from each other.

In inkjet image forming apparatus 1 according to the present embodiment, four head units 24 corresponding to inks of four colors, yellow (Y), magenta (M), cyan (C) and black (K), are aligned at predetermined intervals in the order of the colors, Y, M, C and K from the upstream side in the conveyance direction of recording medium P.

Figure 2:
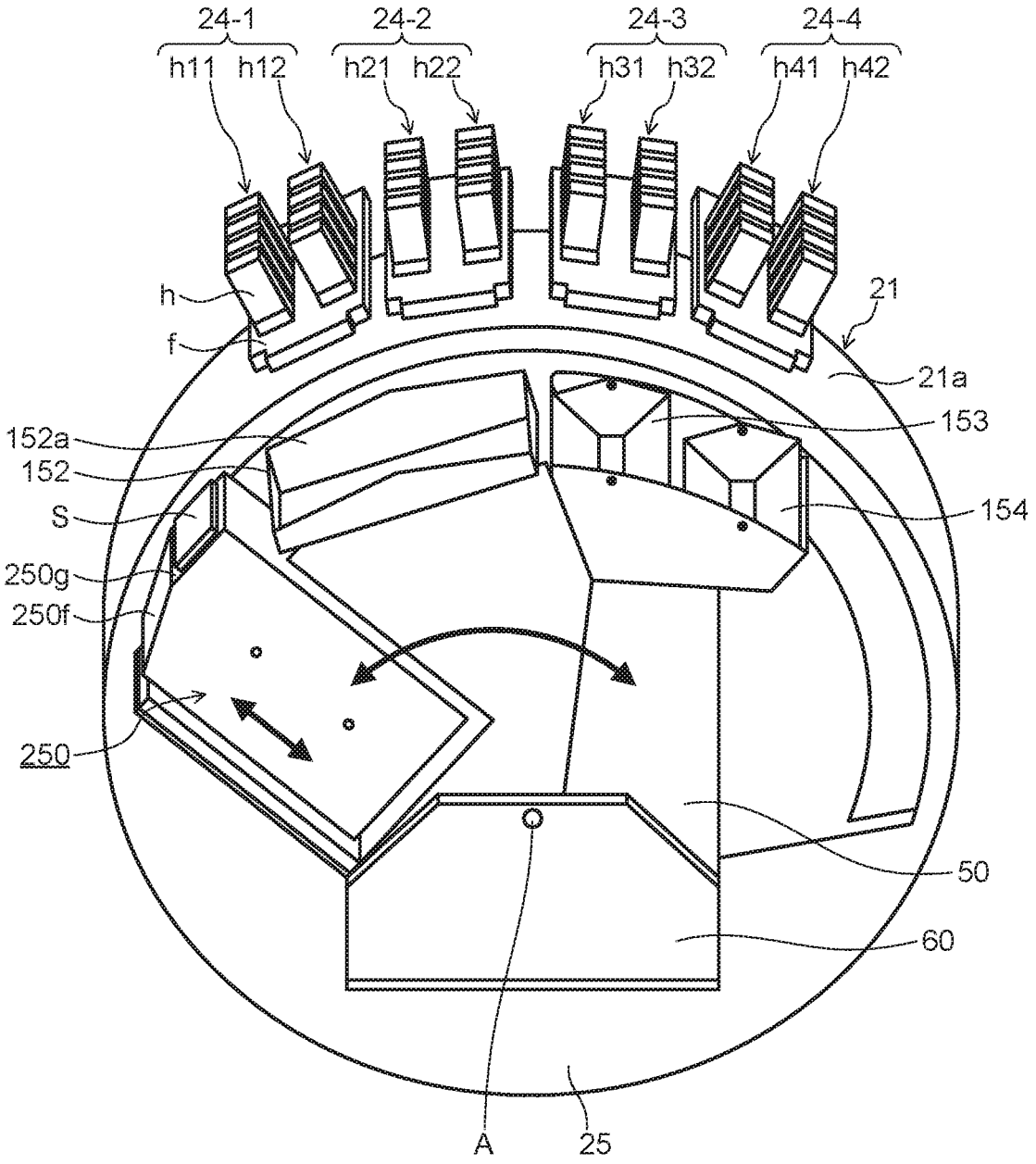
FIG. 2 is a perspective diagram illustrating a conveyance drum, inkjet heads, a cleaning unit, etc., extracted from the inkjet image forming apparatus.

Each head unit 24 includes inkjet heads h (see, for example, FIG. 2). In each inkjet head h, a plurality of recording elements each including a pressure chamber that stores an ink, a piezoelectric element provided on a wall surface of the pressure chamber and a nozzle are provided. In each recording element, upon a drive signal for causing the piezoelectric element to deform being input, the pressure chamber is deformed by the deformation of the piezoelectric element and pressure inside the pressure chamber is thereby changed, causing the ink to be discharged from the nozzle communicating with the pressure chamber.

A range in the orthogonal direction in which the nozzles included in inkjet heads h are disposed covers a width in the orthogonal direction of an area of recording medium P conveyed by conveyance drum 21, in which an image is to be recorded. During formation of an image, each head unit 24 is used with the position of the head unit 24 fixed relative to the rotation axis of conveyance drum 21. In other words, inkjet image forming apparatus 1 is a single-pass apparatus.

The head units 24 are provided so as to be capable of individually moving between image forming drum 21 and cleaning device 25 that are provided along the orthogonal direction. In other words, each head unit 24 is mounted in a non-illustrated carriage and each carriage can be moved in a direction along center axis A by a head conveyance mechanism.

In the present embodiment, under the control of the later-described controller 40, in formation of an image, each head unit 24 moves to a position at which a lower surface of the head unit 24 (that is, nozzle surfaces 24*a* of relevant inkjet heads h) face a circumferential surface of the conveyance drum 21 (printing area), and in any of various types of maintenance, moves to a position at which the lower surface (nozzle surfaces 24*a*) faces cleaning device 25 (maintenance area).

Fixing section 26 includes a light-emitting section disposed over a width in the orthogonal direction of conveyance drum 21. Fixing section 26 applies energy rays such as ultraviolet rays to recording medium P placed on conveyance drum 21 from the light-emitting section to provide predetermined energy to the ink discharged on the recording medium P to heat the ink to a predetermined temperature and thereby cure and fix the ink.

Delivery section 27 includes belt loop 272 including a looped belt, the inside of which is supported by two rollers, and cylindrical delivery drum 271 that delivers recording medium P from conveyance drum 21 to belt loop 272, and conveys recording medium P delivered from conveyance drum 21 onto belt loop 272 by delivery drum 271, via belt loop 272 to feed recording medium P to sheet ejection section 30.

Sheet ejection section 30 includes plate-like sheet tray 31 on which recording medium P fed from image recording section 20 by delivery section 27 is placed.

FIG. 2 is a perspective view illustrating conveyance drum 21, inkjet heads h, cleaning device 25, etc., extracted from inkjet image forming apparatus 1.

As illustrated in the figure, a plurality of head units 24 (24-1, 24-2, 24-3, 24-4) are disposed around conveyance drum 21. Each of head units 24 is a line-type head unit and a plurality of line-type head units are aligned along a circumferential direction of conveyance drum 21. Each head unit 24 extends over an entire length in the width direction of conveyance drum 21.

In this example, as described above, a total of four head units 24 (24-1 to 24-4) is provided so as to enable discharge of inks of four colors, black (K), yellow (Y), magenta (M) and cyan (C); however, the number of head units 24 may be increased/decreased according to the number of colors necessary.

As illustrated in the figure, the head units 24 each have a configuration in which inkjet heads h are attached to base f. More specifically, inkjet heads h are aligned in two rows on each base f along center axis A of conveyance drum 21 and form nozzle rows in printing width direction along center axis A. Inkjet heads h correspond to "cleaning subject member" in the present invention.

Here, where h11 and h12 are head rows of head unit 24-1, h21 and h22 are head rows of head unit 24-2, h31 and h32 are head rows of head unit 24-3 and h41 and h42 are head rows of head unit 24-4, a total of eight head rows (h11 to h42) is formed. These head rows are disposed radially with respect to center axis A at respective angles that are different from each other so that during formation of an image, the nozzle surfaces of inkjet heads h face circumferential surface 21*a* of conveyance drum 21.

Then, in inkjet image forming apparatus 1, as illustrated in FIG. 2, cleaning device 25 is installed adjacent to conveyance drum 21 in the direction along center axis A. Cleaning device 25 includes turning unit 50, ink receiving container 152, ink receiving pans 153, 154 and cleaning unit 250.

Figure 3:
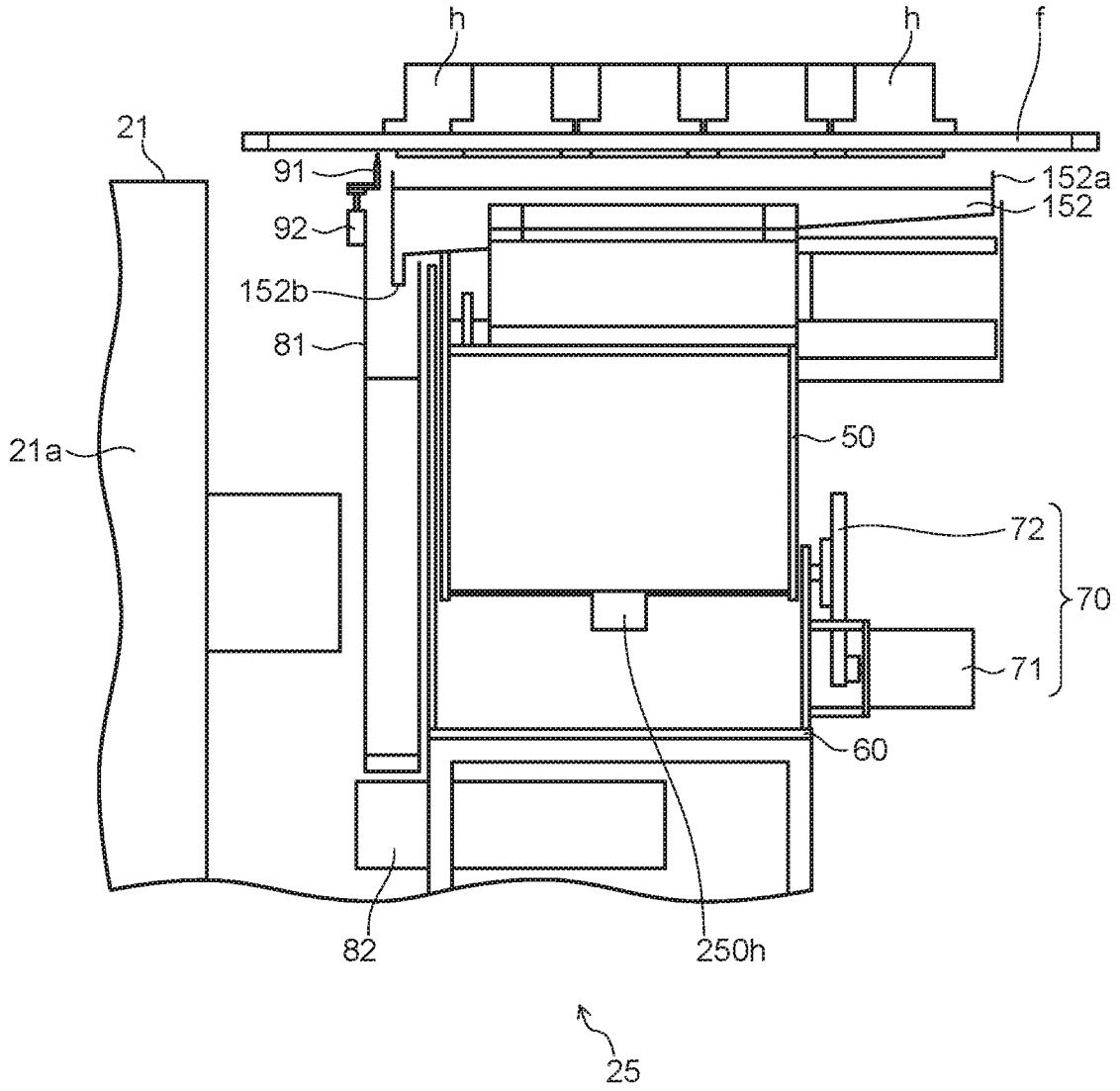
FIG. 3 is a side view of the inkjet image forming apparatus.
Figure 4A:
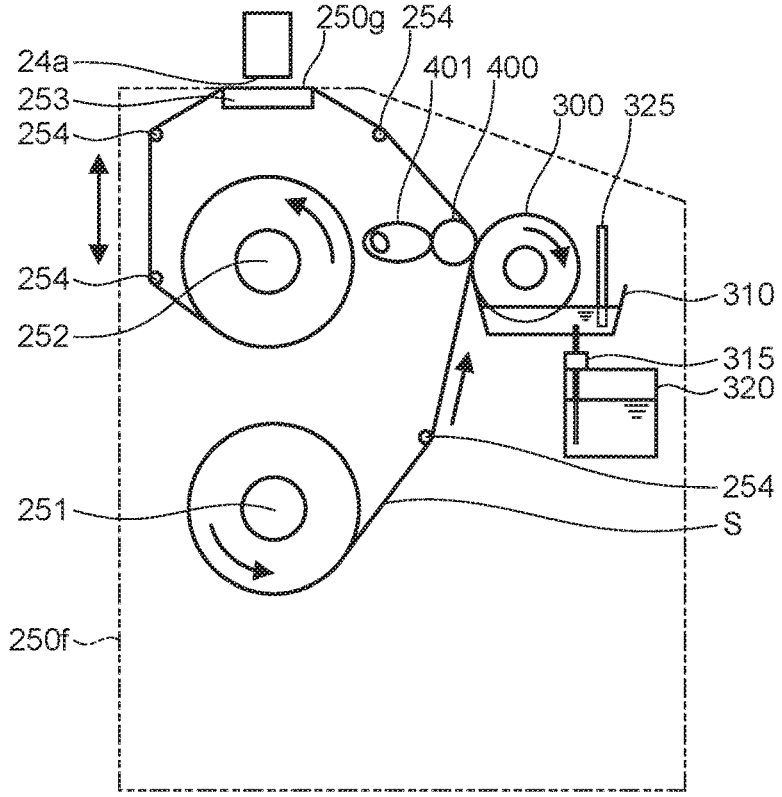
FIGS. 4A and 4B are diagrams each illustrating a configuration of the cleaning unit of the inkjet image forming apparatus.
Figure 4B:
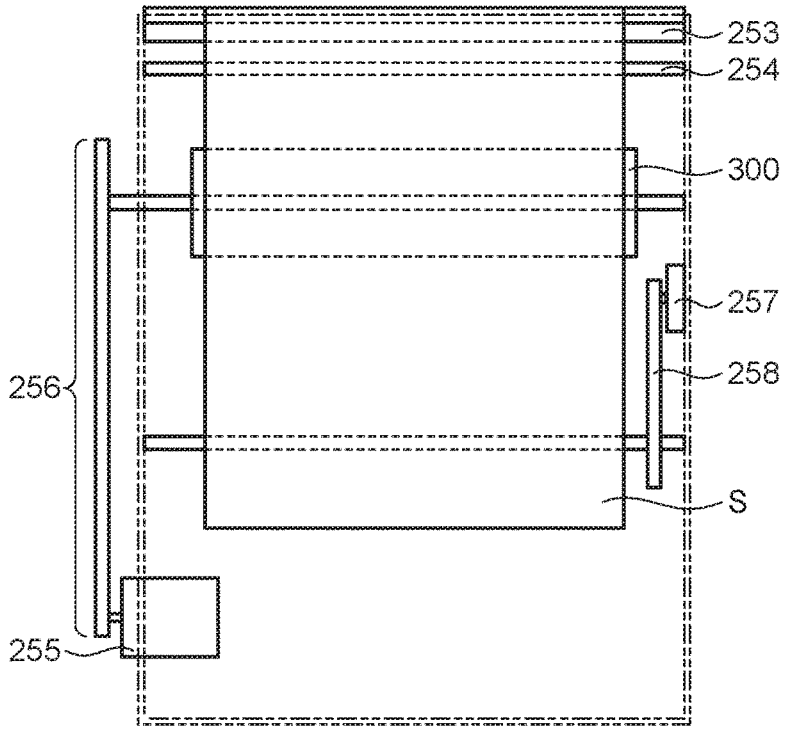

A configuration of cleaning device 25 will be described below with reference to FIGS. 2 to 4. Here, FIG. 3 is a partially-cut side view of inkjet image forming apparatus 1 from the downstream side in the conveyance direction. Also, FIG. 4A is a diagram illustrating a major configuration of cleaning unit 250 and FIG. 4B is a diagram illustrating cleaning unit 250, etc., extracted, as viewed from the downstream side in the conveyance direction.

Turning unit 50 of cleaning device 25 is turnably supported by support frame 60, coaxially with center axis A, and is driven to turn around center axis A by driving device 70 including driving motor 71 and transmission mechanism 72.

Cleaning unit 250 is mounted in turning unit 50. As illustrated in the side view in FIG. 3, cleaning unit 250 is provided adjacent to conveyance drum 21 in the orthogonal direction.

Under the control of controller 40, cleaning unit 250 performs an operation of cleaning nozzle surfaces 24*a* of inkjet heads h (see FIGS. 1 and 4A) before and/or after printing or during maintenance, to remove inks and other foreign substances adhering to nozzle surfaces 24*a*.

More specifically, cleaning unit 250 holds wiping cloth S that serves as a wiping member that wipes nozzle surfaces 24*a* of inkjet heads h. Wiping cloth S corresponds to "cleaning member" in the present invention.

Wiping cloth S is a long sheet member and a length in a width direction of wiping cloth S is set so that wiping cloth S is capable of covering the entire lower surface (that is, nozzle surfaces 24*a*) of head unit 24. For wiping cloth S, for example, non-woven fabric, which is capable of removing ink and other foreign substances adhering to nozzle surfaces 24*a* of inkjet heads h included in head unit 24, can be used.

Also, cleaning unit 250 includes a feeding mechanism for a later-described wiping operation and changing a surface of wiping cloth S to be applied to nozzle surfaces 24*a* to a new surface. As illustrated in FIG. 4A, such feeding mechanism includes supply roll 251 forming the wiping cloth S-feeding source side, winding roll 252 forming the wiping cloth S-winding up side, and soft elastic member 253 and a plurality of rollers 254 disposed on a path between rolls 251 and 252.

Among those, elastic member 253 is disposed on the upper side of casing 250*f*, which corresponds to a position to be applied to nozzle surfaces 24*a* of inkjet heads h. More specifically, elastic member 253 is disposed so as to face opening 250*g* provided in casing 250*f*.

Elastic member 253 has a width that is substantially the same as the width of wiping cloth S and is formed so as to have a size that enables elastic member 253 to cover an entirety of nozzle surfaces 24*a* of inkjet heads h (see FIG. 4A). For a material of elastic member 253, for example, a soft material that even if the material is pressed against nozzle surfaces 24*a* of inkjet heads h, does not damage the nozzles, etc., such as sponge or rubber, is used.

Also, as illustrated in FIG. 4B, the feeding mechanism includes motor (winding motor) 255 that drives winding roll 252, transmission mechanism 256 including pulleys and a belt that transmit a driving force of winding motor 255, motor (feeding motor) 257 that drives supply roll 251 and transmission mechanism 258 including transmission pulleys and a belt that transmit a driving force of feeding motor 257.

In the present embodiment, under the control of controller 40, as illustrated in FIG. 4A, upon winding motor 255 (and feeding motor 257 as the case may be) being rotated and driven, winding roll 252 rotates counterclockwise and winds wiping cloth S. Also, in the present embodiment, under the control of controller 40, upon feeding motor 257 (and winding motor 255 as the case may be) being rotated and driven in a direction opposite to a normal direction, wiping cloth S is moved to the supply roll 251 side to perform a wiping operation in both directions, which will be described later.

Furthermore, as illustrated in FIG. 4A, in the present embodiment, a liquid supply mechanism for supplying a liquid (cleaning liquid L in this example) to wiping cloth S is provided. The liquid supply mechanism includes application roller 300 that applies the liquid (cleaning liquid L) to wiping cloth S, supply tank 310 that receives application roller 300 and cleaning liquid L, storage tank 320 that stores cleaning liquid L and supply pump 315 that supplies cleaning liquid L in storage tank 320 to supply tank 310.

Among those, application roller 300 has a width that is equal to or larger than the width of wiping cloth S, and under the control of controller 40, is rotated and driven upon a driving force of a non-illustrated driving motor being transmitted to application roller 300. Also, supply tank 310 includes liquid level sensor 325 for sensing a liquid level of the cleaning liquid in supply tank 310.

Also, as illustrated in FIG. 4A, opposing roller 400 and cam 401 are disposed at a position facing application roller 300. Opposing roller 400 has a function that pinches wiping cloth S via a nip formed jointly with application roller 300 to stably supply cleaning liquid L supplied from application roller 300 to wiping cloth S.

Also, under the control of controller 40, upon a driving source (non-illustrated driving motor) for cam 401 being controlled, opposing roller 400 is brought into pressure contact with application roller 300 or is moved away from application roller 300 according to a rotational position of cam 401.

Furthermore, as illustrated in FIG. 3, cleaning unit 250 includes raising/lowering mechanism 250*h* that raises/lowers entire cleaning unit 250 (see the straight double arrow indicated in FIG. 2).

Raising/lowering mechanism 250*h* assumes a role of radially outwardly moving an exposed part of wiping cloth S supported by elastic member 253 and exposed from opening 250*g*, to set the exposed part at a position at which the exposed part is in contact with nozzle surfaces 24*a* or radially inwardly moving the exposed part so that the exposed part retracts to a position at which the exposed part is not in contact with nozzle surfaces 24*a* (see FIG. 4A) (moves away from nozzle surfaces 24*a*).

In a specific example, a driving source (see FIG. 5) and a driving mechanism for raising/lowering mechanism 250*h*, air and a control valve are used. In another example, a driving source and/or a driving mechanism such as a motor and/or a solenoid may be used.

Also, ink receiving container 152 is mounted in turning unit 50. Ink receiving container 152 is a container including an upper-end opening 152*a* for receiving waste ink discharged from inkjet heads h and a lower-end outlet 152*b* for making the received waste ink flow into waste ink tank 82.

Upper-end opening 152*a* of ink receiving container 152 has an area that enables upper-end opening 152*a* to respond to two head units 24. Lower-end outlet 152*b* of ink receiving container 152 is disposed on the side close to conveyance drum 21. In this example, a bottom portion of ink receiving container 152 is downwardly inclined toward lower-end outlet 152*b* so that ink entered from upper-end opening 152*a* flows down to lower-end outlet 152*b*. Also, flow passage member 81 that guides waste ink discharged from lower-end outlet 152*b* to waste ink tank 82 is provided.

Also, raising/lowering mechanism 92 that raises/lowers wiper blade 91 is attached to an upper end of flow passage member 81, and wiper blade 91 is disposed above an upper-end opening of flow passage member 81. Wiper blade 91 assumes a role of wiping nozzles 24*a* in a state in which wiper blade 91 is not in contact with nozzle surfaces 24*a* (for example, a state in which wiper blade 91 is, for example, in several tenths of one millimeter proximity to nozzle surfaces 24*a*) to wipe (scrape) off large ink droplets adhering nozzle surfaces 24*a* during maintenance.

Cleaning unit 250, ink receiving container 152 and ink receiving pans 153, 154 are aligned along a circumferential direction in which turning unit 50 turns. Ink receiving pans 153, 154 are disposed on the side opposite to cleaning unit 250 across ink receiving container 152, and cleaning unit 250 and ink receiving container 152 are adjacent to each other.

FIG. 5 is a block diagram illustrating a major functional configuration of inkjet image forming apparatus 1. Inkjet image forming apparatus 1 includes medium heating section 23, inkjet head driving sections ("head driving sections" in the FIG. 240 and inkjet heads h described above included in head units 24, fixing section 26, controller 40, conveyance driving section 51, input/output interface 52 and cleaning unit 250.

Based on control by controller 40, each inkjet head driving section 240 supplies a drive signal for making piezoelectric elements deform according to image data to recording elements of relevant inkjet head h at a proper timing, to make an amount of ink according to a pixel value of the image data be discharged from nozzles of the inkjet head h. Note that as described in detail with reference to FIG. 2, in reality, inkjet heads h are aligned in a plurality of rows in each head unit 24.

Controller 40 includes CPU 41 (central processing unit), RAM 42 (random access memory), ROM 43 (read-only memory) and storage 44. In the present embodiment, controller 40 performs control of a cleaning operation, which will be described later.

CPU 41 reads programs for various types of control and setting data, which are stored in ROM 43, stores the programs and the setting data in RAM 42 and executes the programs to perform various types of arithmetic processing. Also, CPU 41 performs overall control of entire operation of inkjet image forming apparatus 1.

RAM 42 provides a memory space for work to CPU 41 and temporarily stores data. Note that RAM 42 may include a non-volatile memory.

ROM 43 stores, for example, various control programs to be executed by CPU 41 and setting data. Note that instead of ROM 43, a rewritable non-volatile memory such as an EEPROM (electrically erasable programmable read-only memory) or a flash memory may be used.

In storage 44, a print job (print instruction) input from external apparatus 2 via input/output interface 52 and image data relating to the print job are stored. For storage 44, for example, an HDD (hard disk drive) is used and, for example, a DRAM (dynamic random-access memory) may be used in combination.

Conveyance driving section 51 supplies a drive signal to the conveyance drum motor of conveyance drum 21 based on a control signal supplied from controller 40, to rotate conveyance drum 21 at a predetermined speed and timing. Also, conveyance driving section 51 supplies a drive signal to each of respective motors for making medium supply section 12, delivery unit 22 and delivery section 27 to operate, based on a control signal supplied from controller 40, to cause medium supply section 12, delivery unit 22 and delivery section 27 to perform supply of recording medium P to conveyance drum 21 and ejection of recording medium P from conveyance drum 21.

Input/output interface 52 mediates data transmission and reception between external apparatus 2 and controller 40. Input/output interface 52 is formed of, for example, any of various serial interface and various parallel interface or any of combinations thereof.

External apparatus 2 is, for example, a personal computer, and supplies, for example, an image recording instruction (print job) and image data to controller 40 via input/output interface 52.

Cleaning unit 250 includes a plurality of motors (first to n-th motors) as driving sources and a plurality of sensors (first to n-th sensors) as a sensing section. Details of these driving sources and the sensing section will be described later.

Next, an overview of a conventional head cleaning operation for cleaning nozzle surfaces 24*a* of inkjet heads h will be described. Note that in the below-described conventional operation is premised on an example in which no supply of cleaning liquid L to wiping cloth S by application roller 300 described above is performed.

First, controller 40 controls the head conveyance mechanism to move the carriages to the maintenance area to dispose head units 24 in the maintenance area. Subsequently, controller 40 controls driving motor 71 to turn turning unit 50 and thereby move ink receiving container 152 below head units 24-1, 24-2.

Next, controller 40 makes all of the nozzles of inkjet heads h included in head row h11 discharge ink.

Next, controller 40 controls the head conveyance mechanism to move the carriages to the printing area, that is, move head units 24 to the printing area. In this movement, wiper blade 91 and nozzle surfaces 24*a* are brought close to each other in a non-contact manner as described above, and nozzle surfaces 24*a* of inkjet heads h included in head row h11 are thereby wiped. As a result of nozzle surfaces 24*a* being wiped, large ink droplets adhering to nozzle surfaces 24*a* are removed and the ink droplets are made to flow into waste ink tank 82 via flow passage member 81.

Next, controller 40 controls raising/lowering mechanism 92 to lower wiper blade 91 and subsequently returns head units 24 to the maintenance area.

Next, controller 40 controls driving motor 71 to turn turning unit 50 to move the part of wiping cloth S, the part being exposed (projecting) from opening 251*g* of casing 250*f*, below head row h11 as illustrated in FIG. 4A. Then, controller 40 controls raising/lowering mechanism 250*h* to raise casing 250*f* of cleaning unit 250 to press the projecting part of wiping cloth S against nozzle surfaces 24*a* of head row hl 1 and thereby absorb and remove ink remaining on nozzle surfaces 24*a*.

Next, controller 40 controls raising/lowering mechanism 250*h* to lower casing 250*f* of cleaning unit 250 to move wiping cloth S away from inkjet heads h included in head row h11. Thus, a head cleaning task for head row h11 ends.

Next, controller 40 controls the relevant driving motor to wind wiping cloth S to set a new area of wiping cloth S in opening 250*g*. Then, controller 40 performs a head cleaning task for head row h12 in such a manner that is similar to the above.

Controller 40 repeats the above-described processing until head cleaning tasks for all of inkjet heads h mounted in head units 24 end and then moves turning unit 50 to an initial position, which is illustrated in FIG. 2, and moves the carriages to set head units 24 in the printing area.

Here, where a head cleaning task is performed using cleaning device 25 such as described above, for example, there is the problem of, during cleaning using wiping cloth S, being unable to sufficiently absorb and remove ink remaining on nozzle surfaces 24*a* of inkjet heads h, depending on, for example, the type of ink used.

In order to respond to such problem, it is conceivable to perform control of supplying cleaning liquid L to wiping cloth S using application roller 300 described above and wiping nozzle surfaces 24*a* using wiping cloth S thus brought in a wet state.

Here, from the perspective of performing favorable cleaning while curbing an amount of cleaning liquid consumed, it is necessary to change an amount of cleaning liquid or the like to be supplied to wiping cloth S and thus nozzle surfaces 24*a* according to, for example, the amount of residual ink adhering to nozzle surfaces 24*a*, the viscosity of the residual ink and/or whether or not the cleaning has been completed.

More specifically, for example, as the viscosity of the residual ink adhering to nozzle surfaces 24*a* is larger, it is necessary to supply a larger amount of liquid to wiping cloth S and thus nozzle surfaces 24*a* to wet respective parts of nozzle surfaces 24*a*, the residual ink adhering to the parts. Also, after removal of the residual ink, it is necessary to stop the supply of the liquid to nozzle surfaces 24*a* and absorb cleaning liquid L or the like remaining on nozzle surfaces 24*a*, with a dry part of wiping cloth S.

Regarding this point, the aforementioned technique described in Japanese Patent Application Laid-Open No.

2010-280067 provides the configuration in which an amount of cleaning liquid L to be supplied to nozzle surface 24*a* is changed according to the diameter of particles of a functional material included in residual ink, with no consideration of the viscosity of the residual ink.

Also, in the first place, the configuration in which cleaning liquid L is sprayed using a sprayer to wet nozzle surfaces 24*a*, such as in Japanese Patent Application Laid-Open No. 2010-280067, causes unevenness of spraying, and thus, makes it difficult to evenly wet wiping cloth S and furthermore, causes, for example, the problem of a mist of cleaning liquid L flying and falling on other members.

Regarding this point, a configuration in which a plurality of rows of ports for supply of cleaning liquid L are arranged in the vicinity of wiping cloth S and elastic member 253 to supply (spray) cleaning liquid L to wiping cloth S at a relatively-low flow rate from the respective supply ports is conceivable (see, for example, Japanese Patent Application Laid-Open No. 2014-704). However, such configuration causes generation of gaps between the respective supply ports arranged and thus causes the problem of consuming time until wiping cloth S evenly gets wet with cleaning liquid L supplied from the supply ports.

As a result of conducting a diligent study in view of such problems as above, the present inventors have obtained the following findings.

In order to quickly and evenly wet wiping cloth S without making the liquid fly, it is better to use a liquid supply member (typically, a rotating body such as a roller) that holds a liquid on a surface thereof and directly press the surface of the liquid supply member against wiping cloth S to transfer (apply) the liquid to wiping cloth S rather than spraying via the atmosphere such as spraying using a sprayer or a plurality of supply ports described above. From such perspective, in the present embodiment, application roller 300 is employed as a liquid supply member or a liquid application member.

On the other hand, where a liquid supply member (liquid application member) such as mentioned above is used, there is the technical problem of difficulty in making an amount of liquid to be supplied to wiping cloth S adjustable. Also, while after removal of residual ink and the like, it is necessary to make the liquid or the like remaining on nozzle surfaces 24*a* soak into a dry part of wiping cloth S, there is also a problem in how to secure the dry part of wiping cloth S.

Regarding this point, it is conceivable to move the liquid supply member and wiping cloth S relative to each other to adjust a force of pressure contact between the both members and thereby adjust an amount of liquid to be supplied to wiping cloth S. More specifically, in the example configuration illustrated in FIG. 4A, it is conceivable to drive cam 401 to adjust pressure of the nip formed by opposing roller 400 and application roller 300 and thereby adjust an amount of cleaning liquid L to be supplied to wiping cloth S.

Also, it is conceivable to employ a configuration in which cam 401 is driven to move opposing roller 400 away from application roller 300 and thereby cause application roller 300 and wiping cloth S to be spaced from each other to secure a dry part of wiping cloth S.

However, it has turned out that with such configuration, even if the force of pressure contact between application roller 300 and wiping cloth S is adjusted, as long as the both members are in contact with each other, liquid (cleaning liquid L) on a surface of application roller 300 is transferred to wiping cloth S by means of, for example, a capillary action and it is thus difficult to adjust the amount of liquid to be supplied.

Also, it has turned out that with the above-described configuration including turning unit 50, an angle (posture) of cleaning unit 250 varies depending on the respective head units 24-1 to 24-4 and it is further difficult to adjust an amount of liquid to be supplied, based on the adjustment of the force of pressure contact between the liquid supply member and wiping cloth S.

In view of the aforementioned problems, in the present embodiment, in order to adjust the amount of liquid to be supplied to wiping cloth S, a configuration in which a plurality of areas that are different from each other in capability of holding liquid (amount of liquid held per unit area) are provided in the surface of application roller 300, which is a liquid supply member.

In other words, application roller 300 according to the present embodiment includes a plurality of holders that hold a different amount of cleaning liquid L (liquid) from each other in the surface thereof.

An example configuration of application roller 300 and the liquid supply mechanism according to the present embodiment will be described below with reference to FIG. 6.

Figure 6:
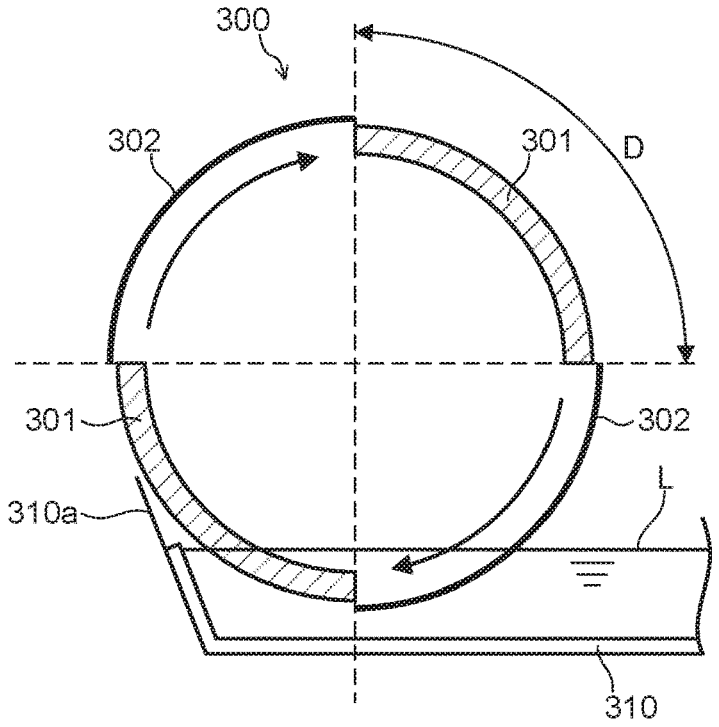
FIG. 6 is a diagram illustrating an example configuration of an application roller in a cleaning device.

As illustrated in FIG. 6, a plurality of (two in the illustrated example) cleaning liquid holders 301, each of which is a liquid supply area for supplying a liquid to wiping cloth S, are provided in a discrete manner in the surface of application roller 300 in the present embodiment.

Here, each cleaning liquid holder 301 (liquid supply area) can have a configuration in which a porous foam material such as sponge is disposed. In this case, the amount of liquid held per unit area can be changed by changing a thickness and/or foaming conditions (for example, a pore size) of the foam material.

In the illustrated example, each cleaning liquid holder 301 (liquid supply area) has a configuration in which a foam material is fixed to a cutout area formed by cutting the surface of application roller 300, via, for example, an adhesive.

As another example, each cleaning liquid holder 301 (liquid supply area) can have a configuration in which a plurality of grooves that can hold a liquid by means of surface tension. For example, the surface of application roller 300 is subjected to anilox processing to form a liquid supply area.

Where a plurality of grooves are provided in the surface of application roller 300 as a liquid supply areas, the amount of liquid held per unit area can be changed by changing a depth of the groove from the surface of application roller 300. In other words, as the grooves are deeper, a larger amount of liquid can be held.

Also, a plurality of (two in the illustrated example) non-cleaning liquid holders 302, each of which is a non-liquid supply area for preventing supply of a liquid to wiping cloth S (cleaning member), are provided in a discrete manner in the surface of application roller 300. Each non-cleaning liquid holder 302 (non-liquid supply area) is a flat surface in which a material of application roller 300 (for example, a resin or a metal such as SUS) is exposed.

As illustrated in FIG. 6, in the present embodiment, in the surface of application roller 300, cleaning liquid holders 301 (liquid supply areas) and non-cleaning liquid holders 302 (non-liquid supply areas) are aligned so as to alternately come into contact with wiping cloth S along with rotation of application roller 300 (see the auxiliary lines indicated by the dotted lines in FIG. 6).

In the present embodiment, cleaning liquid holders 301 and non-cleaning liquid holders 302 correspond to "holders" in the present invention. Note that from among the holders, each of non-cleaning liquid holders 302 is an area in which an ideal value for the amount of liquid held is zero.

Also, in the present embodiment, length D in the conveyance direction of each cleaning liquid holder 301 (liquid supply area) of application roller 300 is longer than an effective length of nozzle surface 24*a* of each inkjet head h (maximum length between the respective discharge ports).

Such configuration as above enables securing a sufficient area of wiping cloth S to which cleaning liquid L is supplied (applied), and as a result, during a wiping operation, which will be described later, it is possible to prevent wiping nozzle surface 24*a* with a dry part of wiping cloth S (wearing nozzle surface 24*a* by rubbing the dry part against nozzle surface 24*a*).

Likewise, a length in the conveyance direction of each non-cleaning liquid holder 302 (non-liquid supply area) of application roller 300 is also longer than the effective length of nozzle surface 24*a* of each inkjet head h (maximum length between respective discharge ports).

Such configuration as above enables securing a sufficient area of wiping cloth S to be fed as it is in a dry state with no cleaning liquid L supplied (applied) thereto. Therefore, when residues of cleaning liquid L or the like are absorbed, which will be described later, it is possible to prevent a failure to sufficiently absorb the residues of cleaning liquid L or the like due to a wet part of wiping cloth S being brought into contact with nozzle surfaces 24*a*.

Also, as another example, the length in the conveyance direction of each non-cleaning liquid holder 302 (non-liquid supply area) of application roller 300 may be shorter than the effective length of nozzle surfaces 24*a* of inkjet heads h (maximum length between the respective discharge ports). In this case, in order to secure a dry part of wiping cloth S, controller 40 appropriately performs control to stop rotation of application roller 300 or move opposing roller 400 away from application roller 300.

Furthermore, as illustrated in FIG. 6, in application roller 300 according to the present embodiment, steps are formed between non-cleaning liquid holders 302 (non-liquid supply areas) and cleaning liquid holders 301 (liquid supply areas). More specifically, a radius of non-cleaning liquid holders 302 (non-liquid supply areas) from an axis (point of intersection between the auxiliary lines indicated by the dotted lines) of application roller 300 is larger than a radius of cleaning liquid holders 301 (liquid supply areas) from the axis of application roller 300.

Also, in the present embodiment, as illustrated in FIG. 6, plate-like blade 310*a* (collection member) for collecting liquid adhering to each non-cleaning liquid holder 302 (non-liquid supply area) is provided on the one end side of supply tank 310, the one end side facing opposing roller 400 described above (see FIG. 4A). Blade 310*a* is inclined in a trail (forward) direction relative to a direction in which application roller 300 rotates (clockwise direction indicated by arrows in FIG. 6).

With such configuration as above allows, when application roller 300 rotates in the clockwise direction (see the arrows) in FIG. 6, cleaning liquid holders 301 (liquid supply areas) do not abut on blade 310*a* but non-cleaning liquid holders 302 (non-liquid supply areas) having a larger radius (thickness) abut on blade 310*a*. As a result, cleaning liquid L adhering to non-cleaning liquid holders 302 can be stemmed (or scrapped off) on the distal end side of blade 310*a* and collected into supply tank 310.

In the present embodiment, application roller 300 makes a motion (rotation or stoppage) according to movement of wiping cloth S.

For example, upon driving of the relevant driving motor being controlled by controller 40, application roller 300 rotates according to movement of wiping cloth S.

Also, in the present embodiment, a wiping cloth remaining amount sensor (not illustrated) for sensing a remaining amount of wiping cloth S is provided on the supply roll 251 side described above with reference to FIG. 4A. Controller 40 controls operation of the relevant driving motors so as to change respective rotation speeds of supply roll 251, winding roll 252 and application roller 300 according to a result of sensing by the wiping cloth remaining amount sensor.

More specifically, controller 40 performs control so that as the remaining amount of wiping cloth S on the supply roll 251 side becomes smaller, the driving motor (feeding motor 257) for supply roll 251 is rotated faster and the driving motor (winding motor 255) for winding roll 252 is rotated slower. Such control enables, for example, during a wiping operation in opposite directions along the conveyance direction, which will be described later, nozzle surfaces 24*a* can be wiped with wiping cloth S at a constant speed in each of the opposite directions.

Also, in the present embodiment, a sensing section (not illustrated), such as a photosensor, that senses a position or a phase of application roller 300, the position or the phase facing wiping cloth S, is provided.

Note that as another example configuration of the sensing section, it is possible that where the driving source for application roller 300 is a stepping motor, the position (phase) of application roller 300 is sensed by counting the number of pulses of a pulse signal input to the stepping motor via controller 40. In this case, there is an advantage of being able to omit the photosensor.

In the present embodiment, controller 40 performs control to adjust an amount of cleaning liquid L to be supplied from application roller 300 to wiping cloth S, according to a result of sensing by the above-described sensing section. A method of the control will be described later.

Also, in the present embodiment, controller 40 controls operation of supply pump 315 based on a result of sensing by liquid level sensor 325 described above so that the amount (liquid level) of cleaning liquid L in supply tank 310 is kept constant.

In other words, if liquid level sensor 325 senses that the liquid level of the cleaning liquid L in supply tank 310 becomes lower than a threshold value, controller 40 performs control to drive supply pump 315 to supply cleaning liquid L in storage tank 320 to supply tank 310 so that the liquid level reaches the threshold value.

Figure 7:
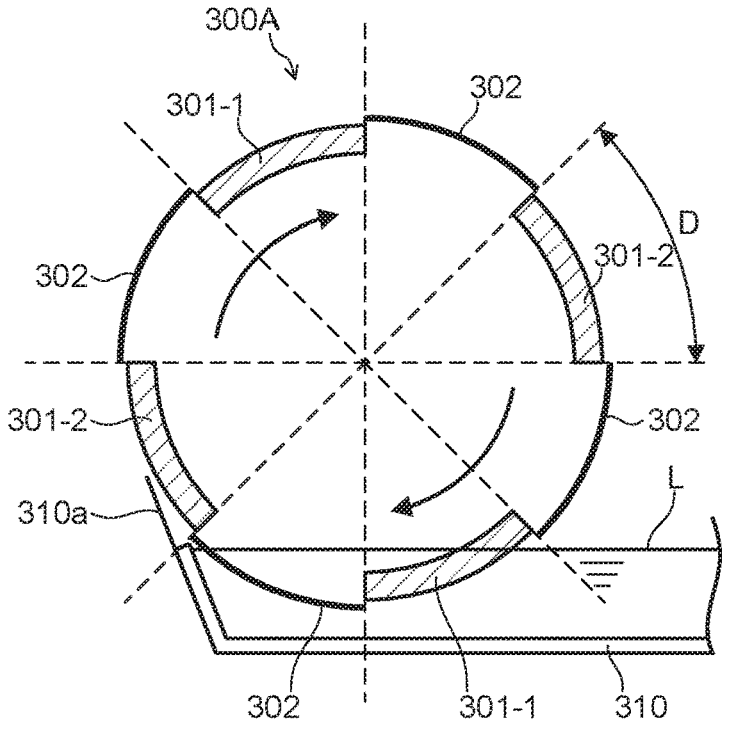
FIG. 7 is a diagram illustrating another example configuration of an application roller.

FIG. 7 illustrates another example configuration of an application roller. As can be seen in comparison with FIG. 6, application roller 300A, which is illustrated in FIG. 7, is configured in such a manner that four cleaning liquid holders 301 (liquid supply areas) and four non-cleaning liquid holders 302 (non-liquid supply areas) show up alternately along with rotational movement of the roller.

From among the aforementioned sections, non-cleaning liquid holders 302 (non-liquid supply area) each have a configuration that is equivalent to that of the example in FIG. 6. Also, a length in the conveyance direction of each of the non-cleaning liquid holders 302 and the cleaning liquid holders 301 (301-1 and 301-2) (see row D) is longer than the effective length of nozzle surfaces 24*a* of inkjet heads h (maximum length between the respective discharge ports).

On the other hand, in application roller 300A, in cleaning liquid holders 301 (liquid supply areas), highly wet areas having a large amount of liquid per unit area and lowly wet areas having a relatively small amount of liquid per unit area are disposed alternately. More specifically, cleaning liquid holders 301-1 are highly wet areas and cleaning liquid holders 301-2 are lowly wet areas.

In other words, under same conditions, an amount of liquid supplied to wiping cloth S from each cleaning liquid holder 301-1 (highly wet area) having a large amount of liquid is larger than an amount of liquid supplied to wiping cloth S from an amount of liquid supplied from each cleaning liquid holder 301-2 (lowly wet area).

For simplicity, in the example illustrated in FIG. 7, an amount of liquid held by cleaning liquid holder 301 (liquid supply area) is set for each of two types of areas, highly wet areas and lowly wet areas, and the highly wet areas and the lowly wet areas are arranged so as to show up alternately along with rotation of application roller 300A. On the other hand, a manner of setting of amounts of liquid held by cleaning liquid holders 301 (liquid supply areas) and a manner of arrangement of wet areas can arbitrarily be determined, and, for example, any of cleaning liquid holders 301 (301-1 or 301-2) may be changed to a medium wet area having a medium amount of liquid held.

Also, during a cleaning operation, controller 40 may detect environmental conditions (for example, a type of ink, a temperature and a humidity and/or a length of time from an end of printing), estimate a viscosity of ink remaining on nozzle surfaces 24*a* of head units 24 and determine (select) a type of cleaning liquid holders 301 (wet areas) to be used for cleaning, according to a result of the estimation.

The content of control by controller 40 for a cleaning operation will be described below with reference to the flowchart illustrated in FIG. 8.

Figure 8:
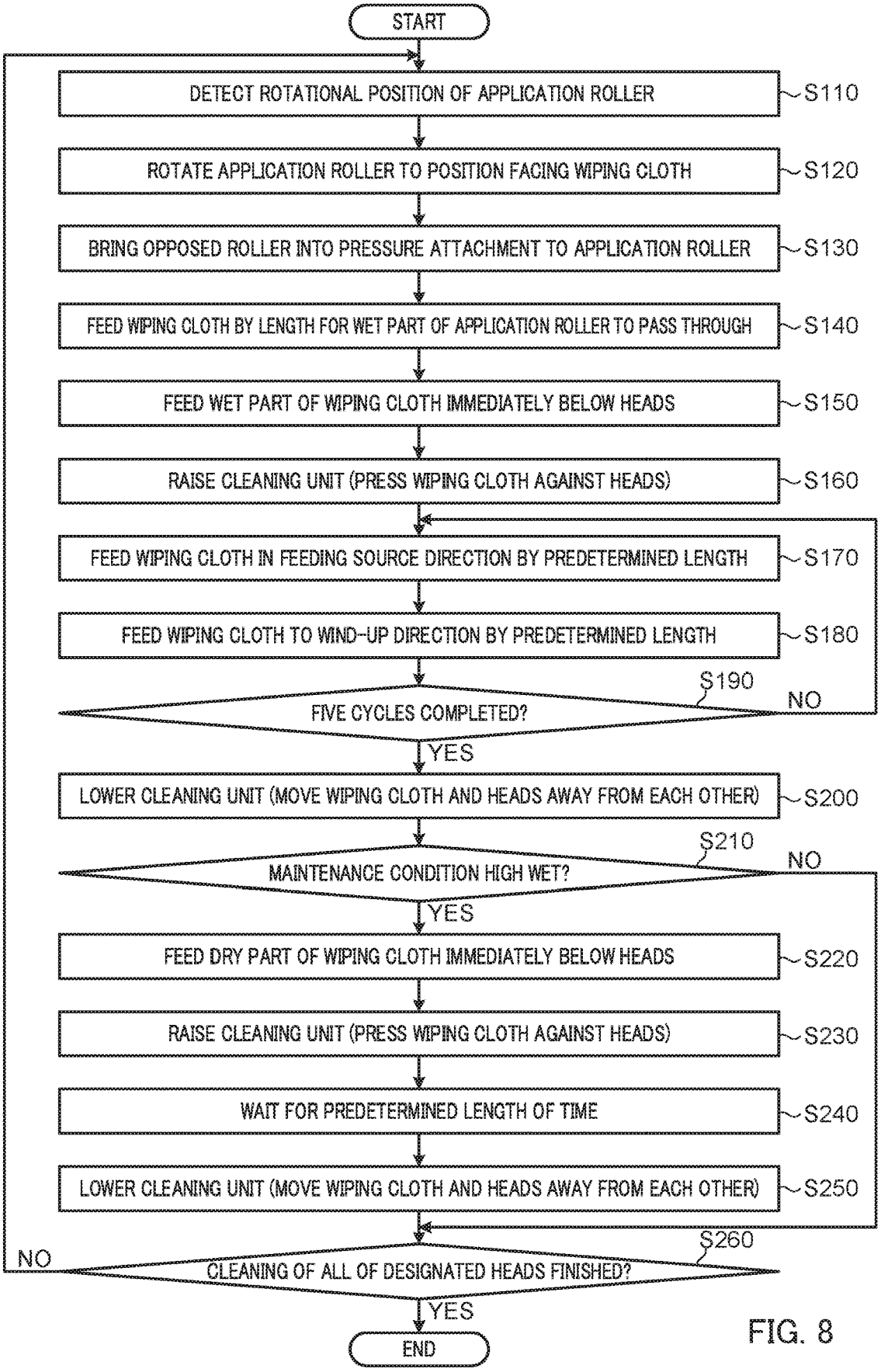
FIG. 8 is a flowchart illustrating an example of processing for cleaning nozzle surfaces of inkjet heads in the present embodiment.

Note that the flowchart illustrated in FIG. 8 is performed after cleaning unit 250 being moved to a position of inkjet heads h designated first as a cleaning subject, by means of turning of turning unit 50 and wiping with wiper blade 91 described above being performed. Also, this example is premised on use of application roller 300A illustrated in FIG. 7.

In step S110, controller 40 detects a rotational position (phase) of application roller 300A from a result of sensing by the above-described sensing section.

In subsequent step S120, controller 40 makes a liquid supply area of application roller 300A (liquid holder 301-1 or 301-2) rotate to a position facing wiping cloth S so as to meet a wet condition designated in advance by a user (see FIG. 4A).

Here, it is assumed that cleaning liquid holder 301-2, which is a lowly wet area, is the wet condition designated in advance.

In step S130, controller 40 controls the driving source for cam 401 described above so that opposing roller 400 is brought into pressure attachment to application roller 300A. As a result of this operation, a wet part (cleaning liquid holder 301-2) of application roller 300A is brought into abutment or close contact with wiping cloth S and cleaning liquid L is thereby transferred from cleaning liquid holder 301-2 to wiping cloth S, and wiping cloth S thus starts getting wet.

In step S140, controller 40 makes application roller 300A rotate so as to feed wiping cloth S by the length in the conveyance direction of the wet part (cleaning liquid holder 301-2) of application roller 300A (arrow D in FIG. 7). Here, controller 40 appropriately controls driving of winding motor 255 and feeding motor 257 so that application roller 300A and wiping cloth S move at a same speed. As a result of the operation, wiping cloth S moves toward elastic member 253 and a part of wiping cloth S, the part corresponding to the length (D) in the conveyance direction of the liquid supply area (cleaning liquid holder 301-2) of application roller 300A, is wetted with cleaning liquid L.

Subsequently, controller 40 controls the driving source for cam 401 to move opposing roller 400 away from application roller 300A.

In step S150, controller 40 controls driving of winding motor 255 to feed the wiping cloth S (that is, wind wiping cloth S via winding roll 252) until one end side of the wet part (wet area) of wiping cloth S (rear end side in the conveyance direction) comes immediately below (that is, faces) inkjet heads h that are the cleaning subject (see FIG. 4A).

In step S160, controller 40 controls driving of raising/lowering mechanism 250*h* to raise cleaning unit 250 to press the wiping cloth S against inkjet heads h. As a result of this operation, the one end side of the wet part of wiping cloth S is brought into close contact or abutment with nozzle surfaces 24*a* of inkjet heads h and nozzle surfaces 24*a* thereby get wet with cleaning liquid L.

In step S170, controller 40 controls driving of feeding motor 257 so that wiping cloth S is fed (back) in a feeding source direction by a predetermined length (for example, 5 mm). As a result of this operation, the area of wiping cloth S, the area being wet with cleaning liquid L, is moved to the right side in FIG. 4A and thereby wipes nozzle surfaces 24*a*.

In next step S180, controller 40 controls driving of winding motor 255 to feed wiping cloth S in a winding-up direction by a predetermined length (for example, 5 mm). As a result of this operation, the wet area of wiping cloth S is moved to the left side in FIG. 4A and thereby wipes nozzle surfaces 24*a*.

In other words, processing in steps S170 and S180 makes the area of wiping cloth S, the area being wet with cleaning liquid L (wet part), perform an operation of wiping nozzle surface 24*a* of inkjet heads h in the both directions along the conveyance direction while being pressed against nozzle surfaces 24*a* of inkjet heads h. Therefore, residual ink, dirt, etc., adhering to nozzle surfaces 24*a* are removed (cleaned off) from nozzle surfaces 24*a*.

In step S190, controller 40 determines whether or not the above-described wiping operation has been performed a predetermined number of cycles (5 cycles, that is, five round-trip in this example). Here, if controller 40 determines that the wiping operation has not yet been performed the predetermined cycles (NO in step S190), controller 40 returns to step S170 and repeats the above-described operation of wiping in the both directions.

On the other hand, if controller 40 determines that the wiping operation has been completed the predetermined number of cycles (YES in step S190), controller 40 proceeds to step S200.

In step S200, controller 40 controls driving of raising/lowering mechanism 250*h* to lower cleaning unit 250 to move wiping cloth S away from inkjet heads h.

In step S210, controller 40 determines whether or not this wiping operation has been performed under a highly wet condition (that is, wiping cloth S has been wetted using a highly wet area (cleaning liquid holder 301-1) of application roller 300A).

Here, if controller 40 determines that this wiping operation has not been performed under a highly wet condition (step S210, NO), controller 40 regards no residues of cleaning liquid L or the like as remaining on nozzle surfaces 24*a* and makes the processing skip to step S260. Therefore, as described above, if wiping cloth S is wetted using a lowly wet area (cleaning liquid holder 301-2) of application roller 300A, controller 40 proceeds to step S260.

On the other hand, if controller 40 determines that this wiping operation has been performed under a highly wet condition (step S210, YES), controller 40 regards cleaning liquid L or the like as remaining on nozzle surfaces 24*a* and proceeds to step S220.

In step S220, controller 40 controls driving of winding motor 255 to feed a dry part (area with no cleaning liquid L applied thereto as a result of being brought into abutment with non-cleaning liquid holder 302 of application roller 300A) of wiping cloth S to a position immediately below nozzle surfaces 24*a*, the position facing nozzle surfaces 24*a*.

In subsequent step S230, controller 40 controls driving of raising/lowering mechanism 250*h* to raise cleaning unit 250. As a result of this operation, the dry part of wiping cloth S is brought into close contact with or is pressed against nozzle surfaces 24*a* of inkjet heads h.

In step S240, controller 40 waits for a predetermined length of time (for example, three seconds). As a result of this waiting operation, if there are residues of cleaning liquid L or the like remaining on nozzle surfaces 24*a*, the residues are completely absorbed by the dry part of wiping cloth S, the dry part being in close contact with nozzle surfaces 24*a*, by means of, for example, a capillary action.

In step S250, controller 40 controls driving of raising/lowering mechanism 250*h* to lower cleaning unit 250 to move wiping cloth S away from inkjet head h.

In step S260, controller 40 determines whether or not cleaning of all of inkjet heads h designated has finished.

Here, if controller 40 determines that cleaning of all of inkjet heads h designated has not yet finished (step S260, NO), controller 40 controls driving motor 71 to turn turning unit 50 to move cleaning unit 250 to a position of inkjet heads h that are a next cleaning subject. Subsequently, controller 40 returns to step S110 and repeats the above-described processing in steps S110 to S260.

On the other hand, if controller 40 determines that cleaning of all of inkjet heads h designated has finished (step S260, YES), controller 40 ends the series of processing steps.

According to the present embodiment in which the above-described operation is performed, it is possible to adjust a supply amount of cleaning liquid L (liquid) to be supplied to wiping cloth S, which is a cleaning member, with a simple and low-cost configuration and evenly wet wiping cloth S without making cleaning liquid L fly. Therefore, the present embodiment enables properly supplying cleaning liquid L (liquid) to wiping cloth S (cleaning member).

The above embodiment has been described in terms of the example configuration of a cleaning device that, with inkjet heads h in head unit 24 as a cleaning subject member, cleans nozzle surfaces 24*a* of inkjet heads h (cleaning unit 250, which is a head cleaning device).

On the other hand, the cleaning device (cleaning unit 250) according to the present embodiment may be applied to a belt cleaning device of an inkjet image forming apparatus including a conveyance belt that conveys recording medium P and a transfer belt serving as an intermediate transfer member. In other words, a cleaning subject member to be cleaned by the cleaning device according to the present embodiment can arbitrarily be determined and may be any of various members that ink or the like may adhere to, for example, a conveyance belt or an intermediate transfer member.

Figure 9:
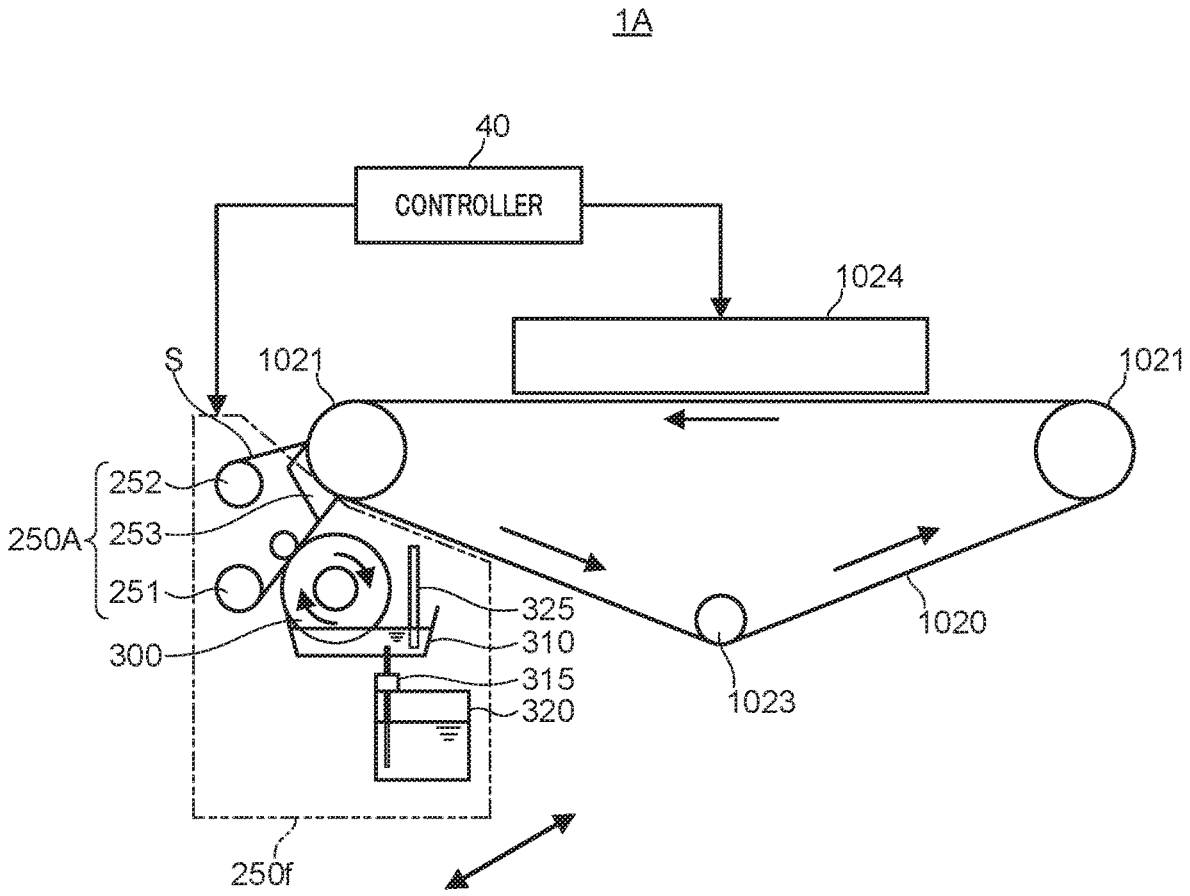
FIG. 9 is a diagram illustrating a case where the cleaning unit in the present embodiment is configured as a belt cleaning device in an inkjet image forming apparatus including a conveyance section using a conveyance belt.

Next, an alteration of the cleaning device (cleaning unit 250) will be described with reference to FIG. 9 onwards. FIG. 9 is a diagram illustrating a case where the cleaning device according to the present embodiment is applied to a belt cleaning device of inkjet image forming apparatus 1A. Note that in FIG. 9, parts that are equivalent to those of the above-described head cleaning device are provided with reference numerals that are the same as those of the above-described head cleaning device and description thereof will appropriately be omitted.

Inkjet image forming apparatus 1A includes a conveyance section using conveyance belt 1020 instead of conveyance drum 21 described above. More specifically, inkjet image forming apparatus 1A includes head unit 1024 with inkjet heads h (see FIG. 2) mounted therein, conveyance belt 1020 that conveys recording medium P (not illustrated in FIG. 9), rollers 1021 to 1023 around which conveyance belt 1020 is rotatably looped, and controller 40 that performs overall control of the apparatus.

Among those, roller 1021 is a driving roller to which motive power of a non-illustrated belt driving motor is transmitted. Also, roller 1022 is a driven roller and roller 1023 is a tension roller that applies tension to conveyance belt 1020.

Also, as illustrated in FIG. 9, inkjet image forming apparatus 1A includes belt cleaning unit 250A, which is a cleaning device for cleaning conveyance belt 1020. Belt cleaning unit 250A includes a feeding mechanism for wiping cloth S (supply roll 251, winding roll 252, elastic member 253, etc.) and a supply mechanism for cleaning liquid L (application roller 300, supply tank 310, storage tank 320, supply pump 315, etc.) described above.

In this example, an entirety of belt cleaning unit 250A (casing 250*f* and internal components thereof) is movable relative to conveyance belt 1020 in respective directions in which belt cleaning unit 250A is brought into pressure contact with, and is spaced from, conveyance belt 1020 (see the double arrow), by a non-illustrated driving source (for example, a solenoid) controlled by controller 40.

The belt cleaning device illustrated in FIG. 9 faces driving roller 1021 that drives conveyance belt 1020 and cleans a part of conveyance belt 1020, the part being looped around driving roller 1021. Therefore, elastic member 253 has a width that is substantially the same as a width of conveyance belt 1020, and as illustrated in FIG. 9, has a shape recessed in an arc shape corresponding to an arc of driving roller 1021.

Next, processing performed by controller 40 for cleaning of conveyance belt 1020 will be described with reference to the flowchart illustrated in FIG. 10. Note that the flowchart is executed where a predetermined execution condition is met. Here, examples of the predetermined execution condition include selection of an execution button by a user, coming of a regular maintenance time and activation of the inkjet image forming apparatus (start-up of the machine).

In step S310, controller 40 detects a rotational position (phase) of application roller 300 from a result of sensing by the above-described sensing section. This processing is similar to step S110 in FIG. 8.

In subsequent step S320, controller 40 detects a rotational position (phase) of conveyance belt 1020.

In next step S330, controller 40 makes a liquid supply area (cleaning liquid holder 301) of application roller 300 rotate to a position facing wiping cloth S so as to meet a predetermined wet condition. Such processing is similar to step S120 described with reference to FIG. 8 and for simplicity, this example is premised on use of application roller 300 described with reference to FIG. 6.

In step S340, controller 40 controls the driving source for cam 401 described above so that opposing roller 400 is brought into pressure attachment to application roller 300. As a result of this operation, the liquid supply area (cleaning liquid holder 301) of application roller 300 is brought into abutment or close contact with wiping cloth S and cleaning liquid L is thereby transferred from cleaning liquid holder 301 to wiping cloth S, and wiping cloth S thus starts getting wet.

In step S350, controller 40 makes wiping cloth S be fed by a length in a conveyance direction of the liquid supply area (cleaning liquid holder 301) of application roller 300 (arrow D in FIG. 6). At this time, application roller 300 and wiping cloth S move at a same speed, and as a result, a part of wiping cloth S, the part corresponding to the length in the conveyance direction of the liquid supply area (cleaning liquid holder 301) of application roller 300, is wetted with cleaning liquid L.

In step S360, controller 40 controls driving of winding motor 255 (see FIG. 4B) to feed wiping cloth S until the wet part (wet area) of wiping cloth S comes to a position facing driving roller 1021 in conveyance belt 1020 (wind wiping cloth S via winding roll 252).

In step S370, controller 40 controls driving of the driving source to raise belt cleaning unit 250A to press wiping cloth S against conveyance belt 1020. As a result of this operation, the wet part of wiping cloth S is brought into close contact or abutment with conveyance belt 1020 and a corresponding part of conveyance belt 1020 thereby get wet with cleaning liquid L.

In step S380, controller 40 makes conveyance belt 1020 rotate one revolution (see FIG. 9). As a result of this operation, the wet part of wiping cloth S, the wet part being pressed against conveyance belt 1020, wipes a surface of conveyance belt 1020 that is rotating, while wetting the surface with cleaning liquid L. Therefore, residual ink, dirt, etc., adhering to conveyance belt 1020 are removed (cleaned off) from conveyance belt 1020.

In step S390, controller 40 controls driving of the driving source to lower belt cleaning unit 250A to move wiping cloth S away from conveyance belt 1020.

In step S400, controller 40 controls driving of winding motor 255 to feed wiping cloth S until a dry part (part in a dry state with cleaning liquid L not applied thereto) of wiping cloth S comes to the position facing driving roller 1021 in conveyance belt 1020 (wind wiping cloth S via winding roll 252).

In step S410, controller 40 controls driving of the driving source to raise belt cleaning unit 250A to press wiping cloth S against conveyance belt 1020. As a result of this operation, the dry part of wiping cloth S is brought into abutment or close contact with conveyance belt 1020.

In step S420, controller 40 makes conveyance belt 1020 rotate one revolution. As a result of this revolution operation, residues of cleaning liquid L or the like remaining on the surface of conveyance belt 1020 are absorbed while being wiped (rubbed) by the dry part of wiping cloth S that is in contact with the surface.

In step S430, controller 40 controls driving of driving source to lower belt cleaning unit 250A to move wiping cloth S away from conveyance belt 1020 and ends the series of processing steps.

According to the present embodiment in which the above-described operation is performed, it is possible to adjust a supply amount of cleaning liquid L to be supplied to wiping cloth S, with a simple and low-cost configuration and evenly wet wiping cloth S without making cleaning liquid L fly.

Generally, the present embodiment enables properly supplying cleaning liquid L (liquid) to wiping cloth S (cleaning member).

Figure 10:
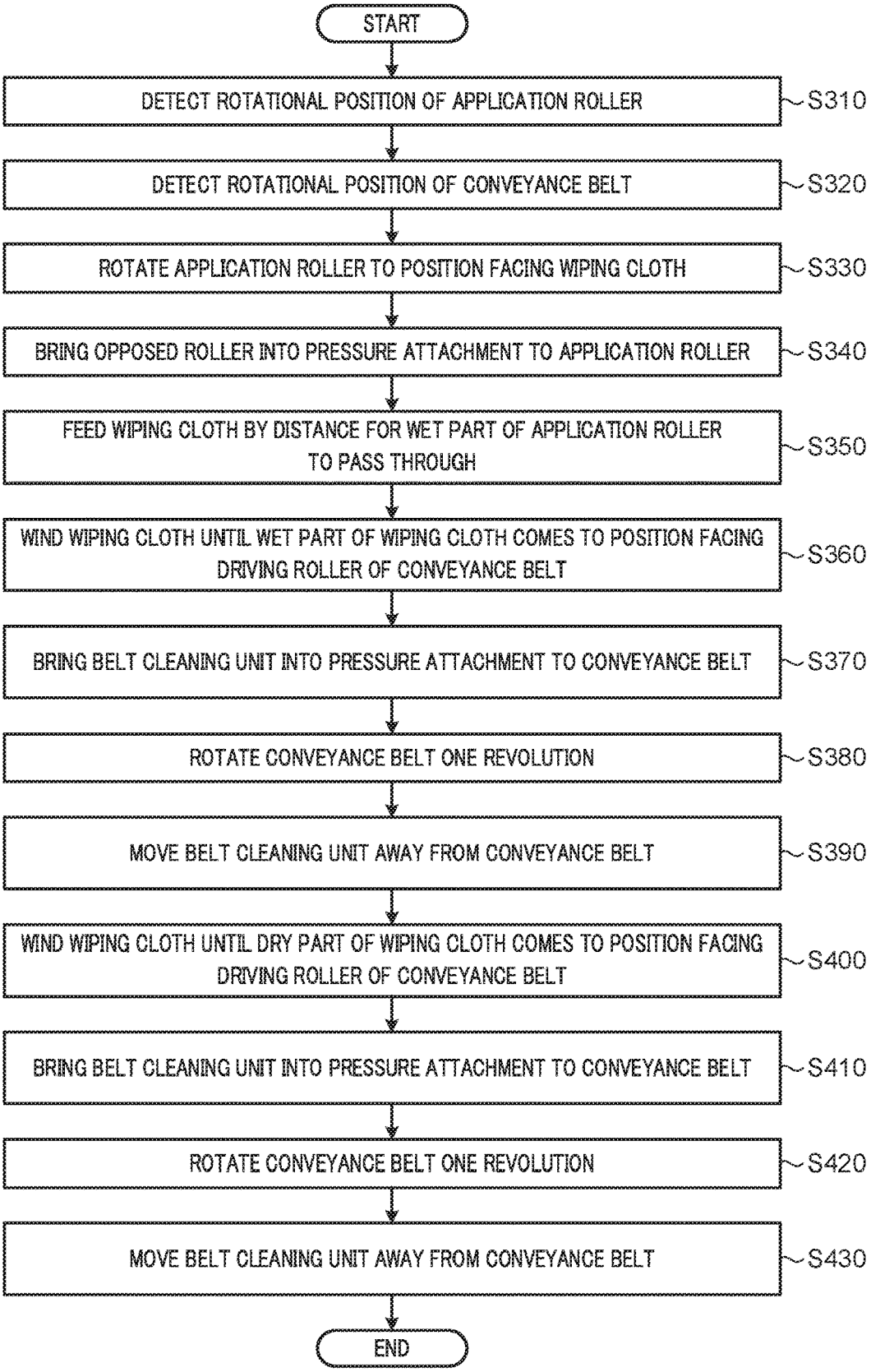
FIG. 10 is a flowchart illustrating an example of processing for cleaning the conveyance belt in the present embodiment.

FIGS. 9 and 10 illustrate an example configuration where conveyance belt 1020 is cleaned. However, a configuration and control that are similar to those described above can also be employed for cleaning of an intermediate transfer member such as a non-illustrated transfer belt.

Although embodiments of the present invention have been described and illustrated in detail, the disclosed embodiments are made for purpose of illustration and example only and not limitation. The scope of the present invention should be interpreted by terms of the appended claims.

What is claimed is:

1. A cleaning device, comprising:

a cleaner that comes into contact with a cleaning subject member and cleans the cleaning subject member using a liquid; and a liquid supplier having a surface configured to make contact with the cleaner, the liquid supplier holds the liquid on the surface that is in contact with the cleaner and supplies the held liquid to the cleaner via the surface to clean the subject member, wherein the liquid supplier includes a plurality of holders on the surface that hold a different amount of the liquid from each other.

2. The cleaning device according to claim 1, wherein the liquid supplier is a rotating body that rotates along with movement of the cleaner.

3. The cleaning device according to claim 2, further comprising a controller that controls rotation of the rotating body.

4. The cleaning device according to claim 3, further comprising a sensor that senses a rotational position in the rotating body, the rotational position facing the cleaner, wherein the controller performs control to adjust an amount of the liquid to be supplied from the liquid supplier to the cleaner according to a result of the sensing by the sensor.

5. The cleaning device according to claim 1, wherein a non-liquid supply area for preventing or minimizing the liquid to be supplied to the cleaner is provided on the surface of the liquid supplier.

6. The cleaning device according to claim 5, wherein the non-liquid supply area and a liquid supply area for supplying the liquid to the cleaner that is in contact with the liquid supply area are disposed on the surface of the liquid supplier so as to alternately face the cleaner along with rotation.

7. The cleaning device according to claim 6, further comprising a collector that comes into abutment with the non-liquid supply area and collects the liquid adhering to the non-liquid supply area, wherein the liquid supply area of the liquid supplier has a shape that prevents the liquid supply area from coming into contact with the collector.

8. The cleaning device according to claim 6, wherein at least two liquid supply areas each being the liquid supply area for supplying the liquid to the cleaner are provided in the liquid supplier and an amount of liquid to be supplied from one or more of the liquid supply areas to the cleaner is different from an amount of liquid to be supplied from another one or more of the liquid supply areas to the cleaner.

9. The cleaning device according to claim 6, wherein the liquid supply area of the liquid supplier includes a foam material.

10. The cleaning device according to claim 6, wherein the liquid supply area of the liquid supplier includes a plurality of grooves that are capable of holding the liquid.

11. The cleaning device according to claim 6, wherein the non-liquid supply area of the liquid supplier is a flat surface.

12. The cleaning device according to claim 6, wherein:

the cleaning subject member is an inkjet head; and a length in a conveyance direction of the liquid supply area of the liquid supplier is longer than an effective length of a nozzle surface of the inkjet head.

13. The cleaning device according to claim 1, wherein the cleaning subject member is an inkjet head.

14. The cleaning device according to claim 1, wherein the cleaning subject member is a conveyance body that conveys a recording medium.

15. The cleaning device according to claim 1, wherein the cleaning subject member is an intermediate transfer member that transfers an ink discharged from an inkjet head to a recording medium.

16. A head cleaning device, comprising the cleaning device according to claim 1, the cleaning device being movable, wherein:

the cleaning subject member is an inkjet head; and the cleaner moves relative to the inkjet head to clean a nozzle surface of the inkjet head.

17. The head cleaning device according to claim 16, wherein the cleaning device is movable in respective directions in which the cleaning device is brought into contact with and is spaced from the inkjet head.

18. An inkjet image forming apparatus, comprising:

the head cleaning device according to claim 16; and a conveyor that conveys a recording medium in such a manner that the recording medium faces the inkjet head.

19. The inkjet image forming apparatus according to claim 18, wherein:

a plurality of the inkjet heads are provided along a direction of conveyance of the recording medium; and the cleaning device is movable in a direction along the nozzle surface of each of the inkjet heads.

* * * * *